US006780063B2

(12) United States Patent
Wang et al.

(10) Patent No.: US 6,780,063 B2
(45) Date of Patent: Aug. 24, 2004

(54) WIRE CONNECTED MODULAR JACK AND ASSEMBLING METHOD

(75) Inventors: Wei Che Wang, Tu-chen (TW); Chin Te Lai, Tu-chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/321,750

(22) Filed: Dec. 16, 2002

(65) Prior Publication Data

US 2004/0106329 A1 Jun. 3, 2004

(30) Foreign Application Priority Data

Nov. 29, 2002 (TW) ..... 91134732 A

(51) Int. Cl.[7] ..... H01R 23/02

(52) U.S. Cl. ..... 439/676

(58) Field of Search ..... 439/676, 701, 439/607–610, 490, 489, 540, 144, 717

(56) References Cited

U.S. PATENT DOCUMENTS

| | | | | |
|---|---|---|---|---|
| 4,327,958 A | | 5/1982 | Hughes et al. | |
| 4,934,947 A | | 6/1990 | Brummans et al. | |
| 4,992,055 A | | 2/1991 | Brummans et al. | |
| 5,769,647 A | * | 6/1998 | Tulley et al. | 439/144 |
| 5,924,896 A | | 7/1999 | Arnett et al. | |
| 6,168,461 B1 | * | 1/2001 | Chang | 439/540.1 |
| 6,375,514 B1 | | 4/2002 | Chih et al. | |
| 6,402,563 B1 | * | 6/2002 | Shi et al. | 439/676 |

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

A modular jack (100) has a housing (1) and a plurality of terminals (5) received in the housing. The housing includes a main body (4), an insert module (2), and a presser (3). The main body defines a cavity (40), a pair of grooves (41), and a pair of slots (42). The insert module has a pair of lead sections (21) slidably received in the grooves and a pair of guide sections (20). The presser has a pair of channels (30) slidably receiving the guide sections of the insert module and a pair of latches (33) reliably engaging with the slots of the main body. The presser further has a pair of blocks (31) abutting against bottom edges of the guide sections.

2 Claims, 3 Drawing Sheets

WIRE CONNECTED MODULAR JACK AND ASSEMBLING METHOD

BACKGROUND OF THE INVENTION

1. Field of the Invention

The present invention generally relates to an electrical connector, and more particularly to a modular jack with a simple structure and a simplified method for assembling the modular jack.

2. Brief Description of the Related Art

Modular jacks are widely used in telecommunication systems for facilitating connection of components thereof. As electrical devices become thinner, electrical connectors should become smaller to benefit such thin and compact electrical devices.

U.S. Pat. No. 6,375,514, issued to Chih on Apr. 23, 2002, discloses a related modular jack. The Chih modular jack has an insulative housing with two receiving spaces, a plurality of terminals received in the receiving spaces, a terminal block with a plurality of wires interwoven thereround, and a shield enclosing the housing. The terminal block has a main body and a pair of inserts. The main body comprises a first part and a second part and each part defines a plurality of through holes adapted to allow threading of the wires therethrough, a plurality of slots each adapted to accept an end of one wire, and a receiving channel adapted to receive one of the inserts therein, whereby the inserts fix the wires to the terminal block. Each wire electrically contacts with a corresponding terminal, which protrudes into the slot containing the end of the wire.

However, the wires are bent several times in being extended through the through holes of the terminal block in order to prevent the wires from being pulled out by accident, which adds to the difficulty of assembling the wires to the modular jack.

Hence, an improved modular jack having a simplified assembling process is needed to solve the above problems.

SUMMARY OF THE INVENTION

It is an object of this invention to provide a modular jack with a simple structure and a simplified assembling process.

It is another object of this invention to provide a simplified method for assembling the modular jack.

An electrical connector in accordance with the present invention includes an insulative housing and a plurality of terminals. The housing has a main body, an insert module and a presser. The main body defines a pair of slots in a rear edge thereof. The insert module has a base section and a plate section, the plate section defining a depression and a pair of first cutouts on a rear surface thereof. The presser forms a protrusion for engaging with the depression of the insert module and a pair of latches for engaging with corresponding slots of the main body, and defines a pair of second cutouts. The second cutouts and the first cutouts together define pilot holes for receiving wires.

Other objects, advantages and novel features of the invention will become more apparent from the following detailed description of a preferred embodiment when taken in conjunction with the accompanying drawings.

DETAILED DESCRIPTION OF THE INVENTION

Figure 1:
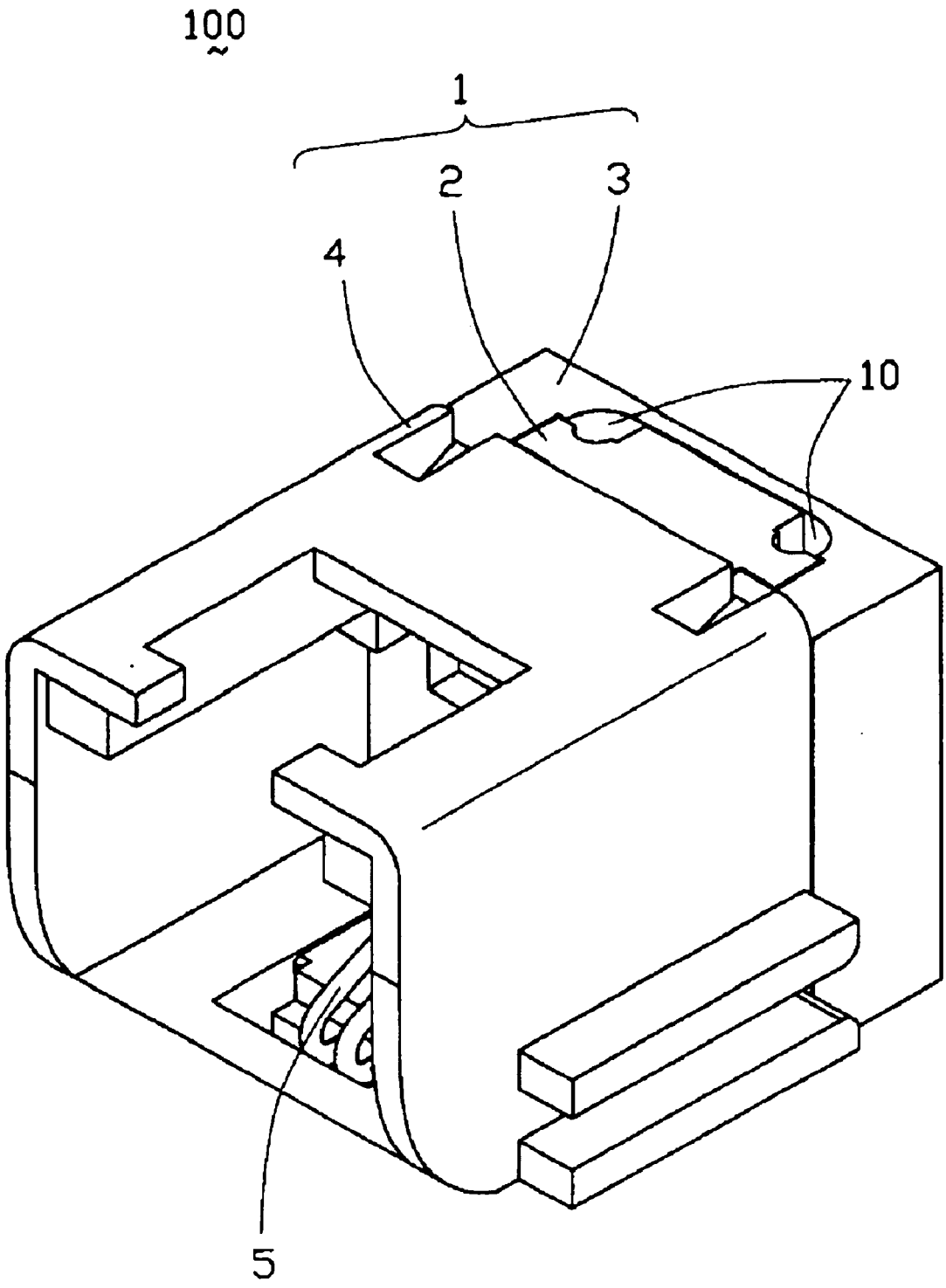
FIG. 1 is a perspective view of a modular jack of the present invention.

Reference will now be made to the drawing figures to describe the present invention in detail.

Figure 2:
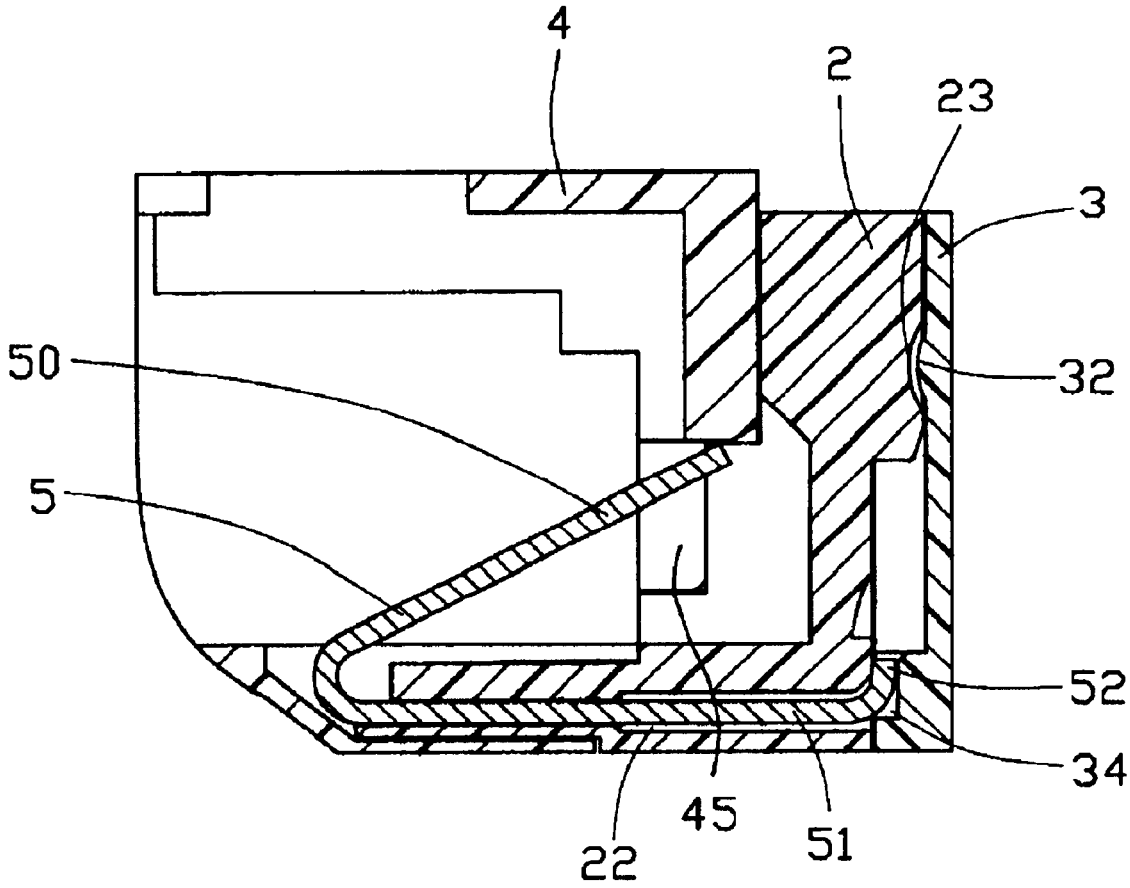
FIG. 2 is a cross-sectional view of FIG. 1.
Figure 3:
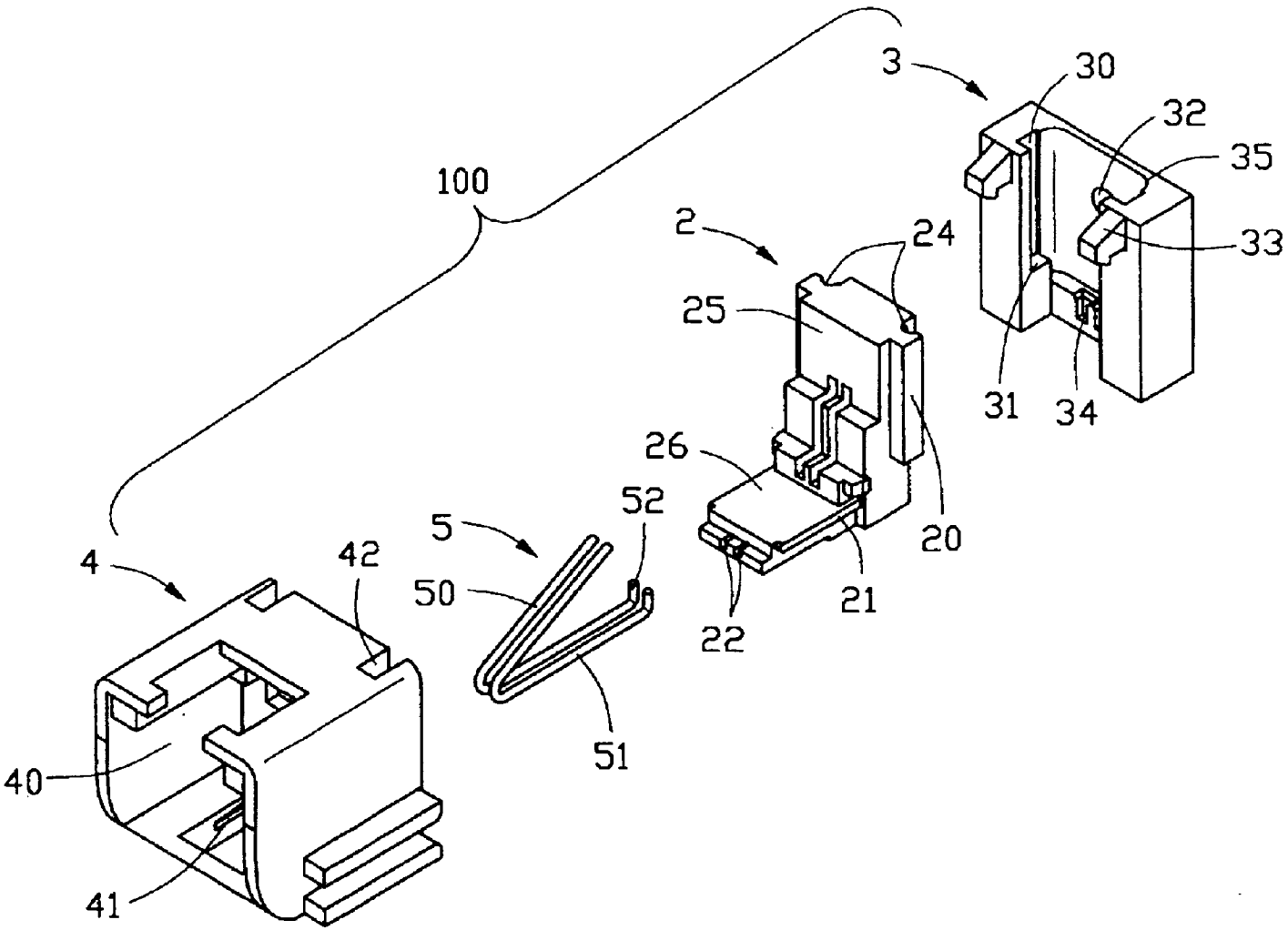
FIG. 3 is an exploded view of FIG. 1.

Referring to FIGS. 1–3, a modular jack 100 in accordance with a preferred embodiment of the present invention has a housing 1 including an insert module 2, a presser 3, and a main body 4, and a plurality of terminals 5 received in the insert module 2 of the housing 1.

The insert module 2 is substantially in an L-shaped configuration and has a plate section 25 and a base section 26. The base section 26 extends forwardly from a bottom edge of the plate section 25. The plate section 25 has a pair of guide sections 20 formed on lateral sides thereof and a pair of first cutouts 24 defined adjacent to corresponding guide sections 20 in a rear wall (not labeled) thereof. The pair of first cutouts 24 extends downwardly toward each other thereby forming a V-shaped configuration. The plate section 25 further defines an indentation 23 in the rear wall thereof The base section 26 has a pair of lead sections 21 formed on lateral sides thereof and a plurality of terminal receiving passageways 22 extending therethrough.

The presser 3 is generally in a shape of a rectangular block and has a rear wall (not labeled) and two side walls (not labeled). A receiving opening (not labeled) is defined between the rear wall and the side walls and extends from a top surface to a bottom surface of the presser 3. The presser 3 forms a pair of latches 33 adjacent to a top edge thereof and a pair of blocks 31 at a bottom portion of the side walls protruding into the receiving opening. The presser 3 also defines a plurality of recesses 34 at a bottom portion thereof and communicating with the receiving opening, and a pair of channels 30 in inner walls of the side walls thereof and communicating with the receiving opening. A protrusion 32 is formed on an inner wall of the rear wall of the presser 3 and protruding into the receiving opening. In addition, a pair of arc-shaped second cutouts 35 is defined in the presser 3 communicating with the receiving opening.

The main body 4 defines a cavity 40, a pair of grooves 41 in a bottom wall (not labeled) thereof, a pair of passageways 45 in a rear wall (not labeled) thereof, and a pair of slots 42 in a rear portion of a top wall (not labeled) thereof.

Each terminal 5 has a contacting section 50, a cantilevered beam section 51 bending rearwardly and horizontally from the contacting section 50, and a connecting section 52 extending upwardly from the cantilevered beam section 51.

A method for assembling the modular jack comprises the following steps:

(a) Assemble the terminals 5 into corresponding terminal receiving passageways 22 of the base section 26 of the insert module 2.

(b) Electrically connect a plurality of wires (not shown) with corresponding free ends of the connecting sections 52 of the terminals 5.

(c) Insert the insert module 2 into the receiving opening of the presser 3 with the guide sections 20 sliding into corresponding channels 30 of the presser 3 from an upper surface toward a bottom surface of the presser 3. A bottom surface of each guide section 20 abuts against a corresponding block 31 of the presser. The first cutouts 24 and corresponding second cutouts 35 together define pilot holes 10 which receive the wires therein. The connecting sections 52 of the terminals 5 are received in corresponding recesses 34 of the presser 3. The protrusion 32 of the presser 3 engages with the indentation 23 of the insert module 2.

(d) Assemble the lead sections 21 of the insert module 2 into corresponding grooves 41 of the main body 4. The contacting portions 50 of the terminals 5 are received in the cavity 40 of the main body 4, and the distal portion of the contacting portion 50 of the terminals 5 is deflectably received in the passageway 45.

(e) The latches 33 of the presser 3 engage with corresponding slots 42 of the main body 4 to secure the housing 1 tightly together.

An advantage of the present invention over the prior art results from the fact that the insert module 2 of the modular jack 100 needs not defining a plurality of slots for receiving corresponding wires which electrically connect the terminals 5 to circuit traces of a printed circuit board (PCB, not shown). Furthermore, the insert module 2 and the presser 3 together define pilot holes 10 for receiving the wires to connect with the terminals 5, and the presser 3 has a pair of latches 33 respectively engage with corresponding slots 42 of the main body 4. As a result, the wires are securely fixed in the modular jack 100 without being bent too many times to prevent from escaping therefrom, thus the structure of the modular jack 100 and the assembling process are remarkably simplified.

It is to be understood, however, that even though numerous, characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack for connecting between a mating plug connector and a plurality of wires connected to a circuit, comprising:

a main body, the main body defining a cavity for receiving the plug connector therein and at least a slot;

an insert module, the insert module forming a pair of guide sections;

a presser, the presser having a pair of channels receiving corresponding guide sections of the insert module, a pair of blocks abutting against bottom surfaces of the guide sections and at least a latch engaging with the slot of the main body, said insert module being secured between the main body and the presser; and a plurality of terminals received in the insert module, each terminal having a contacting section received in the cavity of the main body and a connecting section connecting to a wire;

wherein the main body defines a pair of grooves and the insert module has a pair of lead sections received in corresponding grooves of the main body;

wherein the insert module defines a pair of first cutouts, the presser defines a pair of second cutouts and the first and second cutouts together form a pair of pilot holes for receiving the wires when the insert module is coupled with the presser;

wherein the insert module defines an indentation and the presser forms a protrusion engaging with the indentation of the insert module;

wherein each terminal has a cantilevered beam section bending rearwardly from the contacting portion and a connecting section extending upwardly from a rear end of the cantilevered beam section;

wherein the presser defines a plurality of recesses receiving the connecting sections of the terminals.

2. A three-piece modular jack comprising:

a main body defining a cavity; and a subassembly including an insert module and a presser, said insert modular having therein a plurality of terminals extending into the cavity, said insert module defining an L-shaped configuration with a vertical section and a horizontal section thereof, said presser assembled to the vertical section in a vertical direction, said subassembly assembled to the main body in a horizontal direction;

interlocking means formed on the main body and the presser for preventing the subassembly from being withdrawn from the main body in a direction opposite to said horizontal direction;

wherein a plurality of pilot holes are formed between the vertical section and the presser for protectively holding therein corresponding wires connected to the corresponding terminals, respectively;

wherein said presser defines recesses receiving corresponding terminals therein;

wherein said main body defines passageways to allow the terminals to pass during assembling and further receive a distal portion of a contacting portion of the terminal when the connector is assembled;

wherein said presser is generally in a shape of rectangular block and has a rear wall and two side walls commonly defining a receiving opening to receive the vertical section of the insert module.

* * * * *